US011337495B2

(12) United States Patent
Buck

(10) Patent No.: US 11,337,495 B2
(45) Date of Patent: May 24, 2022

(54) ELECTRONIC PERSONAL JEWELRY ARTICLES

(71) Applicant: Versi LLC, Sheridan, WY (US)

(72) Inventor: Daniel C. Buck, Chicago, IL (US)

(73) Assignee: VERSI LLC, Sheridan, WY (US)

( * ) Notice: Subject to any disclaimer, the term of this patent is extended or adjusted under 35 U.S.C. 154(b) by 0 days.

(21) Appl. No.: 17/091,567

(22) Filed: Nov. 6, 2020

(65) Prior Publication Data

US 2021/0137227 A1 May 13, 2021

Related U.S. Application Data

(60) Provisional application No. 62/932,678, filed on Nov. 8, 2019.

(51) Int. Cl.
*A44C 9/00* (2006.01)

(52) U.S. Cl.
CPC ..... *A44C 9/0053* (2013.01); *A44C 9/0084* (2013.01)

(58) Field of Classification Search
CPC .. A44C 15/0015; A44C 9/0053; A44C 9/0084
USPC ..... 362/104
See application file for complete search history.

(56) References Cited

U.S. PATENT DOCUMENTS 5,653,524 A * 8/1997 Gray ..... A44C 15/0015 362/104
5,690,412 A * 11/1997 Sheldon ..... A44C 15/0015 362/104
6,050,695 A * 4/2000 Fromm ..... A44C 15/0015 362/104
6,833,539 B1 * 12/2004 Maeda ..... A44C 15/0015 250/2 UAL
9,887,591 B2 2/2018 Breedvelt-Schouten et al.
2002/0131266 A1 * 9/2002 Naghi ..... A44C 15/0015 362/104
2005/0056054 A1 * 3/2005 Pourmehdi ..... A44C 9/0053 63/40
2017/0020247 A1 * 1/2017 Petrosyan ..... A44C 17/0233
2017/0065039 A1 * 3/2017 Takeuchi ..... G08B 5/36
2019/0142118 A1 * 5/2019 Torres ..... A44C 15/0015 362/104
2019/0307214 A1 * 10/2019 Vinci ..... A44C 15/0015

FOREIGN PATENT DOCUMENTS

WO WO-2020046296 A1 * 3/2020 ..... G03B 29/00

* cited by examiner

*Primary Examiner* — Jack W Lavinder
(74) *Attorney, Agent, or Firm* — Andrus Intellectual Property Law, LLP

(57) ABSTRACT

A personal jewelry article includes a light source coupled to a power source and located within a compartment interior of a shank of the personal jewelry article. A stone is connected to the shank above the compartment. The light source emits light through the stone and the stone alters the light emitted by the light source.

19 Claims, 4 Drawing Sheets

ELECTRONIC PERSONAL JEWELRY ARTICLES

CROSS REFERENCE TO RELATED APPLICATION

The present application claims priority of U.S. Provisional Patent Application No. 62/932,678 filed on Nov. 8, 2019, the contents of which is incorporated by reference herein in its entirety.

FIELD AND BACKGROUND

The present disclosure relates to personal jewelry items, and specifically to jewelry rings having light sources and slides.

U.S. Pat. No. 9,887,591 discloses an electric ring. The electric ring may include light-emitting diodes (LED) or a display to show text and/or images. The ring includes an energy storage device that transmits energy to the electric ring to power more complex electronics such as a display to show text and/or images.

Personal jewelry items, such as necklaces, earrings, and rings are commonly worn as clothing accessories, and it is not uncommon for a person to own multiple personal jewelry items such that different personal jewelry items can be worn with different types of clothing. Auxiliary power sources add additional bulk to electronic jewelry and therefore further solutions for electronic personal jewelry items are needed.

BRIEF DISCLOSURE

This Brief Disclosure is provided to introduce a selection of concepts that are further described below in the Detailed Disclosure. This Brief Disclosure is not intended to identify key or essential features of the claimed subject matter, nor is it intended to be used as an aid in limiting the scope of the claimed subject matter.

A personal jewelry article, which may be a ring, includes a shank defining a compartment interior of the shank. A light source is configured to emit light and coupled to a power source. The light source and the power source are located within the compartment. A stone is connected to the shank at a position above the compartment. Light from the light source is projected through the stone to alter the light from the light source.

In further examples, the personal jewelry article is a ring and includes an annulus connected to the shank. The stone may be removably connected to the shank. A plurality of resilient prongs extend from the shank. The stone is removably secured to the shank by the plurality of resilient prongs. The stone may include a stone upper secured to the shank and a removable slide that is removably connected to the shank. A slot is defined in the shank at a location above the compartment and below the stone upper. The slot is configured to removably receive the removable slide. A transparent panel is located at the top of the compartment and below the slot. The light source is configured to project light, wherein at least a portion of the projected light travels through the removable slide and then through the stone upper. The removable slide may include at least one hole therethrough through which at least a portion of the projected light travels. The stone upper may include glass or a mineral. The stone upper may include at least one facet. The removable slide may include a lens that directs at least a portion of the projected light towards a center of the stone. The removable slide may include at least one colored pane that is transparent or translucent. The personal jewelry article may include a door that is selectively operable to access the compartment. The stone upper may be secured to the shank with a threaded connection. Opening of the threaded connection between the stone upper and the shank exposes the slot wherein the removable slide is positioned. The power source may be a battery. The light source may be an light emitting diode (LED). A timer may be electrically connected to the power source and to the light source. The timer operates to turn off the light source after a predetermined period of time. A capacitive switch may be located in an outer surface of the personal jewelry article. The capacitive switch is operable change the light source between an on condition to an off condition.

A method of operating a personal jewelry article includes operating the light source to project light through the removable slide and the stone upper. The removable slide is removed from the chamber in the shank. A subsequent removable slide is inserted into the chamber in the shank. The light source is operated to project light through the subsequent removable slide and the stone upper.

BRIEF DESCRIPTION OF THE DRAWINGS

The present disclosure is described with reference to the following Figures. The same numbers are used throughout the Figures to reference like features and like components.

DETAILED DISCLOSURE

The present inventor endeavored to develop personal jewelry articles with interchangeable components such that the person can quickly change the style or appearance of the personal jewelry article. Accordingly, the present inventor developed the personal jewelry articles of the present disclosure described herein below.

Figure 1:
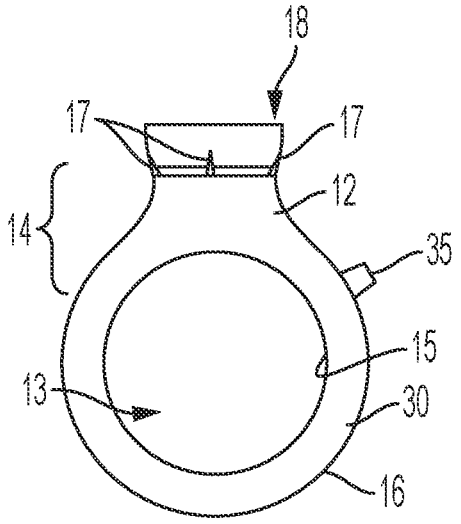
FIG. 1 is side view of an example personal jewelry article according to the present disclosure.

FIG. 1 depicts an exemplary embodiment of a personal jewelry article, and the example personal jewelry article 10 described hereinbelow is a ring to be worn on a finger of a user. However, a person of ordinary skill in the art will recognize that components and features described herein below with respect to the personal jewelry article 10 example of a ring may be incorporated into other embodiments of personal jewelry articles such as earrings, bracelets, necklaces, and the like.

The personal jewelry article 10 has a shank 12. Being a ring, an annulus 30 extends from the shank 12. The annulus 30 defines an opening 13 in which a finger of user is received. It will be recognized that other forms of personal jewelry articles will include other structures that interface with the body of the user, for example, a clip or a post and a back of an earring. The example of the personal jewelry article of a ring 10 will be described herein in further detail. The annulus 30 exemplarily extends from one side of the shank 12 at a shoulder section 14 of the ring 10. The annulus 30 extends in the shape of a circle and returns to connect to an opposite side of the shank 12 in the shoulder section 14 to complete the annulus 30. The annulus 30 has an outer surface 16 that is visible when the ring 10 is worn by a user and an interior surface 15 that contacts and/or faces the finger of the user that is in the opening 13. The interior surface 15 thus at least partially defines the opening 13.

A stone 18 is connected to the shank 12 in the shoulder section 14. The stone 18 may be removably secured to the shank 12. As described in further detail herein, the stone 18 is at least partially transparent or translucent such that the stone 18 is configured to allow light to pass therethrough. The stone 18 further includes at least one property that modifies the light as it passes through the stone 18. As used herein stone 18 refers to the structure and location in the ring 10 rather than any implication that such structure need not be made of a natural or synthetic mineral. As described further, examples of stones may vary in shape, color, size, opacity, and design. Such stones may be constructed of natural or synthetic minerals, glass, ceramic, acrylic, polymers, plastics, metal, or other materials as will be recognized based upon the disclosure.

The stone 18, or a portion of the stone 18, is connected to the shank 12. The connection 32 may be constructed in a variety of manners and may be fixed or removable. In an example of the connection between the shank 12 and the stone 18, one or more prongs 17 extend away from the shank 12 in the shoulder section 14. The prongs 17 engage the stone 18 to secure the stone 18 and to hold it in in place relative to the shank 12 and the shoulder section 14. In certain examples, the shank 12, the annulus 30, the shoulder section 14, and the prongs 17 are integrally formed with each other. These structures may be made from any suitable materials, such as a plastic or a metal alloy.

As noted, the stone 18 may be removably coupled to the shank 12. In related examples, the stone 18 may have multiple components, with at least a portion removably coupled to the shank 12. With a removable stone 18, the user can have multiple stones 18 of different qualities as described in further detail herein, including shape, color, size and design. By swapping out one stone 18 for another stone, the user can change the appearance of the ring 10. The manner in which the stone 18 is coupled to the shank 12 can vary.

In one example, the prongs 17 may resiliently engage the stone 18. The prongs 17 are biased in a position smaller than the stone 18, but may elastically deform to remove the stone 18 from the prongs 17. The prongs 17 also elastically deform as the new stone 18 is placed onto engagement with the prongs 17, for example to flex away from each other as the stone 18 is pressed towards the shank 12. Upon release of the force, the prongs 17 apply inwardly directed compressive forces to the stone 18. In another example, the stone 18 and the prongs 17 have mating components (e.g., twist-lock mating members) for coupling the stone 18 to the ring 10. In still another example, the stone 18 and the shank/shoulder section each have mating screw threads that engage each other to secure the stone 18 to the shank 12. In still another example, the stone 18 and the shank/shoulder section each have one or more clips that selectively couple to each other such. Still further examples of removable connections between the stone 18, or a portion of the stone 18, and the shank/shoulder section will be described in further detail.

The stone 18 is made of any suitable material such as plastic and glass. The stone 18 can also be a gemstone, such as a diamond, emerald, and sapphire, or an imitation gemstone made of silicon carbide, cubic zirconia, or other materials. The size and shape of the stone 18 varies, and in certain examples, the stone 18 has geometric features such as cut lines, curved surfaces, planar surfaces, indentations, depressions, and/or the like. In one example, the stone 18 has one or more convex or concave surfaces that redirect light passing through the stone 18 from a light source 24 (described herein) within the ring 10. In other examples, the stone 18 includes one or more cutouts or bores that permit passage of light from a light source 24.

Figure 2:
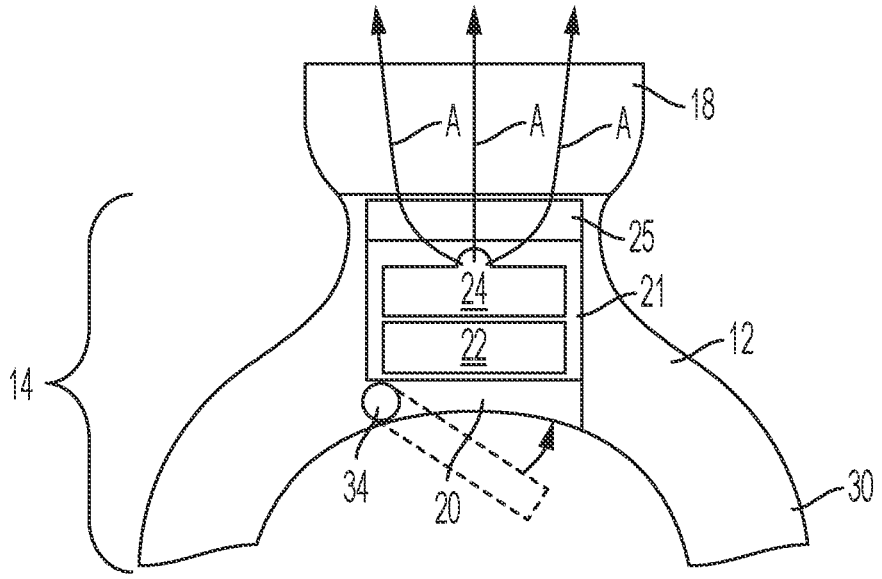
FIG. 2 is an enlarged partial cross-sectional view of a first example of the personal jewelry article.

Referring now to FIG. 2, an enlarged cross-sectional view of a first example of the shoulder section 14 depicting internal components of the ring 10. A compartment 21 is defined within the interior of the shank 12. Electrical components 36 of the ring are positioned within the compartment 21. In the example depicted in FIG. 2, the compartment 21 is within the shank 12. The size and shape of the compartment 21 varies, and in one non-limiting example, the compartment 21 has a rectangular shape. The compartment 21 may further include an optional transparent panel 25 located within the compartment 21 between the electrical components 36 and the stone 18. The optional transparent panel 25 may further serve to protect the electrical components 36 when the stone 18 is removed, if the stone 18 is removable.

A door 20 may be operably coupled to the ring 10 at a hinge 34 permits access to the compartment 21. In this example, the door 20 is pivotably coupled to the interior surface 15 of the ring 10 and is pivotable into a closed position (not shown) to thereby prevent access to the compartment 21. The door 20 pivots about a pivot axis 51 on the outer surface 16. The door 20 prevents entry of moisture and/or debris into the compartment 21. In one example, the door 20 includes a gasket (not shown) extending along the perimeter edge of the door 20 that creates a watertight seal between the door 20 and the shank 12. The door 20 may be operably coupled to the ring 10 in a variety of other manners as will also be recognized. In an example with a door 20, the user gains access to the electrical components 36 of the ring 10 by opening the door 20. The electrical components 36 can then be inspected and/or replaced by the user. FIG. 2 depicts the door 20 (see dashed lines) in an open position such that the compartment 21 is accessible.

As mentioned above, various electrical components 36 of the ring 10 are contained within the compartment 21. Example components contained within the compartment 21 are described hereinbelow. A power source, such as a battery 22, is positioned within the compartment 21. The battery 22 is for providing power to the light source 24 (described below). The battery 22 is located near the first side 41 of the compartment 21, and in the example depicted in FIG. 2, the battery 22 can be easily removed from the compartment 21 when the door 20 is in the open position. In another example, the door 20 may be located opposite as depicted in FIG. 2 wherein the stone 18 is connected to the door 20 or the stone 18 is a part of the door 20, for example when the stone 18 is removable from the shank 12 by a threaded connection. In such an example, the battery 22 is removed via the second side of the compartment 21 when the stone 18 is removed from the ring 10 (as described above).

In certain examples, the battery 22 is disposable (e.g., after power in the battery 22 is discharged, the user removes the battery 22 and replaces the battery 22 with a fully charged new battery) and can be easily removed from the ring 10 as noted above. In other examples, the battery 22 is rechargeable. In these examples, the battery 22 does not need to be removed from the compartment 21 to be recharged. In one instance, the ring 10 includes a wireless charging device that charges the battery 22, for example by induction, when the ring 10 is placed on a wireless charging pad. In another instance, the ring 10 includes a cable port (not shown) that couples to an external charging cable (not shown). Accordingly, when the charging cable is coupled to the cable port, the battery 22 is charged. Note that the charging port could be positioned in the shank, 12, shoulder section 14 or the annulus 30.

The battery 22 is electrically coupled to the light source 24 in the compartment 21 via an electrical circuit. As such, the battery 22 provides electrical power to the light source 24 and the light source 24 emits light A in directions toward and through the optional panel 25 and the stone 18. The light passes through the stone 18 and is thereby visible to the user and other persons looking at the ring 10.

The light source 24 can be any suitable device capable of emitting light toward the stone 19. The example depicted in FIG. 2, the light source 24 contains one or more light-emitting diodes (LED). The light source 24 can further include side surface and/or a plastic encasement in which light emitting devices are encased. The light source 24 could also include compressible materials or layers (such as rubber or silicone) that contact the battery 22, the panel 25, and/or the interior surfaces of the shoulder section 14 to thereby prevent moisture and/or debris from collecting in the compartment 21.

Figure 3:
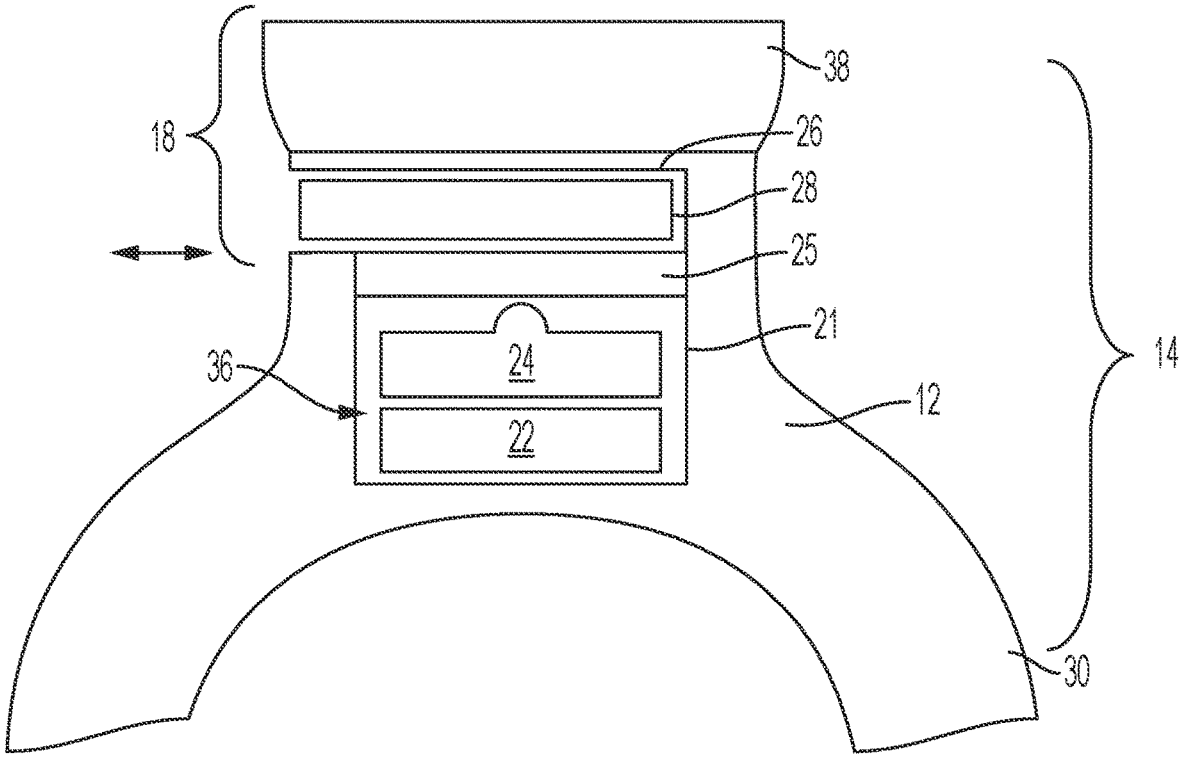
FIG. 3 is an enlarged partial cross-sectional view of a second example of the personal jewelry article.

FIG. 3 depicts a second example of the shoulder section 14 depicting internal components of the ring 10. In FIG. 3, the stone 18 is partially removably secured to the shank 12. The stone 18 includes a fixed stone upper 38 and a removable slide 28. The stone upper 38 is exemplarily clear and transparent as the stone upper 38 serves to protect the removable slide 28 within the shank 12. The removable slide 28 is transparent or translucent, or includes apertures to allow light to pass therethrough. The removable slide 28 provides the variability in the appearance of the visual effect produced by the ring when the light source 24 is illuminated. The stone upper 38 is depicted in FIG. 3 as being flat, such an example may promote viewing an image or design of the light projected through the removable slide 28. While it will be recognized that the stone upper 38 may take other forms, included other shapes (e.g. curved or trapazoidal) or may be faceted. Angled, curved, and/or faceted stone uppers will result in more light refraction, resulting in a more abstract appearance to the projected light.

A slot 26 extends into the shank 12 at a location below the stone upper 38. The slot 26 is located above the compartment 21. The optional panel 25 separates the slot 26 from the compartment 21. The slot is configured to receive the removable slide 28 therein. Light from the light source 24 passes through the removable slide 28 positioned within the slot 26 and the light that passes through the removable slide 28 continues through the stone upper 38.

Figure 4:
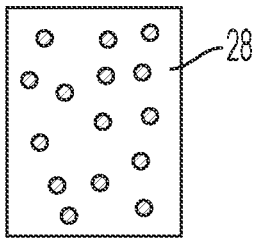
FIGS. 4-7 are top-down plan views of example removable slides as can be used with examples of the personal jewelry article.
Figure 5:
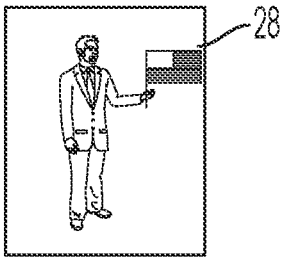
Figure 6:
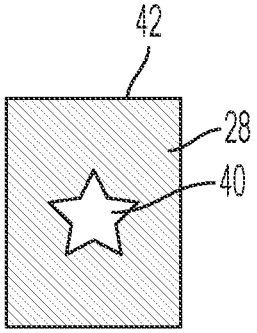
Figure 7:
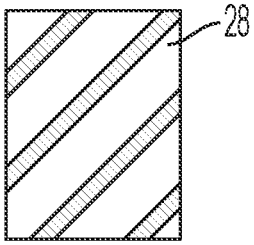

The type of slide 28 can vary, and accordingly, the user can replace the slide 28 to thereby change the appearance of the ring 10 and/or the light passing through the stone 18. In one example, the slide 28 is a light filter that filters the light passing therethrough. For instance, the slide 28 is a blue light filter that filters out blue light from the light source 24 such that only non-blue light passes through the slide 28 and subsequently the stone 18. In other example, such as the examples depicted in FIGS. 4-7, the slide 28 has a pattern that alters light such that a pattern or image is visible through the stone 18. FIG. 4 depicts an example slide 28 with a pattern of transparent colored dots. FIG. 5 depicts an example slide 28 with a translucent colored image of a stick-figure person holding a flag. FIG. 6 depicts an example slide 28 with a star shaped hole 40 through an opaque body 42. FIG. 7 depicts an example slide 28 with a translucent cross-hatching pattern of different colors. In still other examples, the slide 28 includes more or more focusing elements, such as mirrors and lens, that alter the light passing therethrough. In one instance, the slide 28 has a focusing element, such as a convex lens that directs the light toward the center of the stone upper 38.

The size and shape of the slide 28 corresponds to the size and shape of a slot 26 such that the user can easily insert and/or remove the slide 28 from the slot 26, for example in the direction of arrow 44. The slides 28 depicted in FIGS. 3-6 are rectangular and planar. However, in other examples, the slides are non-planar (e.g., the slide 28 can include sloped or curved surfaces and/or portions).

The slide 28 is retained in the slot 26 such that the slide 28 does not inadvertently fall or slide out of the slot 26. The manner in which the slide 28 is retained in the slot 26 can vary. For example, the surfaces of the slide 28 may contact the interior surfaces of the ring 10 such that friction or compression forces between the slide and the interior surfaces of the ring 10 help retain the slide 28 in the slot 26. In another example, an ejector (not shown) in the slot 26 retains or ejects, respectively, the slide 28 in the slot 26. In this example, the user pushes the slide into the slot, the slide 28 compresses a spring of the ejector and the ejector thereby holds or locks onto the slide 28. To remove the slide 28 from the slot 26, the user again pushes the slide 28 towards the spring such that the spring of the ejector is further compressed before the ejector ejects the slide 28 in the opposite direction. As such, the slide extends out of the open end 27 of the slot 26 and the user can grasp the slide 28 and pull the slide 28 out of the slot 26.

Figure 8:
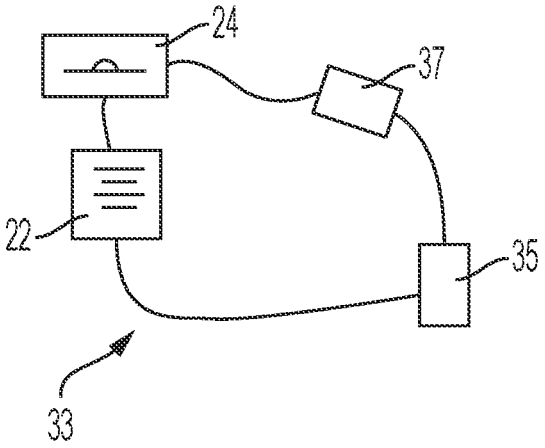
FIG. 8 is a schematic diagram of an example circuit of the personal jewelry article.

Referring now to FIG. 8, a schematic diagram of an example circuit 33 that makes up the electrical components 36 within and/or on the surface of the ring 10 is depicted. The circuit 33 that connects the battery 22 to the light source 24, and the circuit 33 includes an operable switch 35 (see also FIG. 2). The operable switch 35 permits the user to selectively turn the light source 24 "on" or "off". In certain examples, the switch 35 in a mechanical switch and the switch 35 extends from the outer surface 16 of the ring 10. In other examples, the switch 35 is a capacitive switch on or recessed into the outer surface 16 of the ring 10. The circuit 33 includes a timer 37 that times out after a predetermined period of time, such as 1.0 minutes or 30.0 seconds, and thereby turns the light source "off." That is, after the timer 37 times out or a predetermined period of time passes, the light source 24 stops emitting light. The switch 35 must be actuated (and the circuit closed) again in order for the light source 24 to again emit light.

The circuit 33, or portions thereof, are located on or contained within the shank 12, the shoulder section 14, and/or the compartment 21. In one example, a portion of the circuit 33 are on the interior surface 15 of the ring. In another example, a portion of the circuit 33 is contained within a sleeve (not shown) that extending thorough the shank 12.

In the present description, certain terms have been used for brevity, clarity, and understanding. No unnecessary limitations are to be inferred therefrom beyond the requirement of the prior art because such terms are used for descriptive purposes and are intended to be broadly construed. The different apparatuses, systems, and method steps described herein may be used alone or in combination with other apparatuses, systems, and methods. It is to be expected that various equivalents, alternatives and modifications are possible within the scope of the appended claims.

This written description uses examples to disclose the invention, including the best mode, and also to enable any person skilled in the art to make and use the invention. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A personal jewelry article comprising:

a shank defining a compartment interior of the shank;

a light source configured to emit light and coupled to a power source, wherein the light source and the power source are located within the compartment; and a stone connected to the shank at a position above the compartment, wherein the stone comprises a stone upper secured to the shank and a removable slide that is removably connected to the shank and wherein light from the light source is projected through the stone to alter the light from the light source.

2. The personal jewelry article of claim 1, wherein the personal jewelry article is a ring, and further comprising an annulus connected to the shank.

3. The personal jewelry article of claim 1, wherein the stone is removably connected to the shank.

4. The personal jewelry article of claim 3, further comprising a plurality of resilient prongs extending from the shank, wherein the stone is removably secured to the shank by the plurality of resilient prongs.

5. The personal jewelry article of claim 1, further comprising a slot defined in the shank at a location above the compartment and below the stone upper, wherein the slot is configured to removably receive the removable slide.

6. The personal jewelry article of claim 5, further comprising a transparent panel located at the top of the compartment and below the slot.

7. The personal jewelry article of claim 5, wherein the light source is configured to project light, wherein at least a portion of the projected light travels through the removable slide and then through the stone upper.

8. The personal jewelry article of claim 7, wherein the removable slide includes at least one hole therethrough through which at least a portion of the projected light travels.

9. The personal jewelry article of claim 7, wherein the stone upper comprises glass or a mineral.

10. The personal jewelry article of claim 9, wherein the stone upper comprises at least one facet.

11. The personal jewelry article of claim 7, wherein the removable slide comprises a lens that directs at least a portion of the projected light towards a center of the stone.

12. The personal jewelry article of claim 7, wherein the removable slide includes at least one colored pane that is transparent or translucent.

13. The personal jewelry article of claim 7, further comprising a door that is selectively operable to access the compartment.

14. The personal jewelry article of claim 7, wherein the stone upper is secured to the shank with a threaded connection.

15. The personal jewelry article of claim 14, wherein opening of the threaded connection between the stone upper and the shank exposes the slot wherein the removable slide is positioned.

16. The personal jewelry article of claim 7, wherein the power source is a battery and the light source is an light emitting diode (LED).

17. The personal jewelry article of claim 7, further comprising a timer electrically connected to the power source and to the light source, wherein the timer operates to turn off the light source after a predetermined period of time.

18. The personal jewelry article of claim 17, further comprising a capacitive switch located in an outer surface of the personal jewelry article, the capacitive switch operable change the light source between an on condition to an off condition.

19. A method of operating a personal jewelry article of claim 7, the method comprising:

operating the light source to project light through the removable slide and the stone upper;

removing the removable slide from the chamber in the shank;

inserting a subsequent removable slide into the chamber in the shank; and operating the light source to project light through the subsequent removable slide and the stone upper.

* * * * *